United States Patent [19]

Anderson et al.

[11] 4,399,865

[45] Aug. 23, 1983

[54] CONCENTRIC STEAMING STRING DOWNHOLE APPARATUS

[75] Inventors: Glenn W. Anderson, Oildale; Stanley O. Hutchison, Bakersfield, both of Calif.

[73] Assignee: Chevron Research Company, San Francisco, Calif.

[21] Appl. No.: 284,748

[22] Filed: Jul. 20, 1981

[51] Int. Cl.[3] ..... E21B 33/126; E21B 36/00; E21B 43/24

[52] U.S. Cl. ..... 166/191; 166/242; 166/303; 166/57

[58] Field of Search ..... 166/269, 258, 303, 191, 166/305 R, 242, 57

[56] References Cited

U.S. PATENT DOCUMENTS

| | | | |
|---|---|---|---|
| 2,754,098 | 7/1956 | Heinze | 166/303 X |
| 3,349,850 | 10/1967 | Schlicht et al. | 166/303 |
| 3,392,783 | 7/1968 | Reed | 166/303 |
| 3,565,175 | 2/1971 | Wilson | 166/269 |
| 3,630,573 | 12/1971 | Goddin, Jr. et al. | 166/269 X |
| 3,835,889 | 9/1974 | Hyde | 166/191 X |
| 4,081,028 | 3/1978 | Rogers | 166/242 |
| 4,099,563 | 7/1978 | Hutchison et al. | 166/191 |

*Primary Examiner*—Stephen J. Novosad
*Attorney, Agent, or Firm*—G. W. Wasson; Edward J. Keeling

[57] ABSTRACT

A downhole concentric tubing string is disclosed for use in distributing steam, or other hot fluids, to separated subsurface formations along a well bore. The apparatus includes elements for deflecting the steam from one string into the annulus of a cased well for injection through openings into the formation, elements for conducting the steam in another of the concentric string to a second set of openings for injection into another portion of the formation, and elements for isolating and separating the two separate injection intervals.

6 Claims, 2 Drawing Figures

CONCENTRIC STEAMING STRING DOWNHOLE APPARATUS

INTRODUCTION

This invention relates to a downhole steam injection system for use in a steam injection well wherein a concentric tubing string transports the steam to the downhole location and the steam injection system splits the steam from the two concentric tubing strings and distributes the steam to separate locations along the well bore.

BACKGROUND OF THE INVENTION

In some underground petroleum reservoirs the petroleum within the reservoir is of such heavy gravity that even at the temperature of the underground formation the petroleum is immobile and will not flow to a producing well. It has been known to inject into those formations hot liquids or steams with the objective of raising the temperature of the formation to the point where the petroleum within the formation becomes heated to the point where it is mobile enough to be able to flow into a producing well bore.

A large body of technology has developed for the generation of hot fluids or steams at the earth surface and for the transportation of those steams or fluids to the subsurface formations. Further, as the cost of energy has increased, additional attention has been paid to the efficiency of generating and transporting the hot fluids from the surface to the subsurface formation with the objective of maximizing the input of heat into the formation and minimizing the loss of heat through the conductor carrying the hot fluids from the surface to the subsurface formation.

The subsurface formations that are now becoming targets for secondary recovery or steam stimulation techniques are deeper within the earth's formations than formations that were targets years ago and the chances for loss of thermal energy has substantially increased as the well depth increases. In some of the new target formations two different subsurface formations are candidates for the treatment with hot fluids and these different formations may be separated from each other by substantial distances. Further, each formation may be subject to different injection techniques requiring sometimes different temperatures and different pressures for the injection fluids.

It is usual in the above types of injection techniques that the conducting elements that are placed within the earth formation are of a metallic structure and are placed within the formation at the ambient temperatures of the atmosphere. In the usual case wells are drilled, cased and perforated and then steam injection tubing is run into the well and packers are placed between the tubing and the casing above (and sometimes below) the perforations where the hot fluids are to be injected. After the subsurface well elements have been placed in the formation and the well is ready for steam injection, the wellhead is connected to a steam generator and the hot fluid is pumped down into the formation through the well tubing.

The present invention is directed to a downhole apparatus that is connected near the downhole end of the injection tubing to separate the hot fluids from the two concentric tubings and place the hot fluids in position for injection into the formation. The apparatus includes elements for separating the two injection zones from each other so as to permit different zones to be treated in different manners. Further, the separate tubing elements of the concentric string are independent of each other even though connected to a common element.

SUMMARY OF THE INVENTION

In accordance with the present invention a well is drilled into a subsurface formation containing heavy gravity petroleum crude and casing is placed into the well to prepare the formation for production. The casing is perforated or provided with slotted liners in those areas of the subsurface formation where production is expected and the formations are treated in many of several different manners to prepare the formations for injection of hot fluids or steam.

In accordance with the present invention a tubing string is passed down into the casing with its lower end aligned with the formation where the steam is to be injected. In the usual case, a packer is placed above the formations to be treated to insure that the steam that is injected down the tubing string is retained in the area where the heavy gravity crude is located. The outside of the tubing string is anchored in the packer and the packer prevents the injected hot fluids from flowing upwardly through the annulus between the casing and the tubing string.

Above the packer the tubing string is usually centralized within the casing to insure that there is an adequate stand off from the casing to prevent heat loss directly from the tubing string into the casing. The centralizers are preferably of a form of low heat conducting material to further improve the efficiency of the system. The tubing string below the packer may be provided with one or more areas of steam injection and the separate areas of steam injection may be separated from each other by steam deflectors and/or packers. With concentric injection tubings used in the well, the outside tubing is provided with an expansion joint between the upper packer and the wellhead whereas the inner tubing expands toward the wellhead where that expansion is accommodated. A suitable wellhead configuration is disclosed in our copending application Ser. No. 284,747, filed July 20, 1981, for Dome-type Packoff Wellhead.

Figure 1:
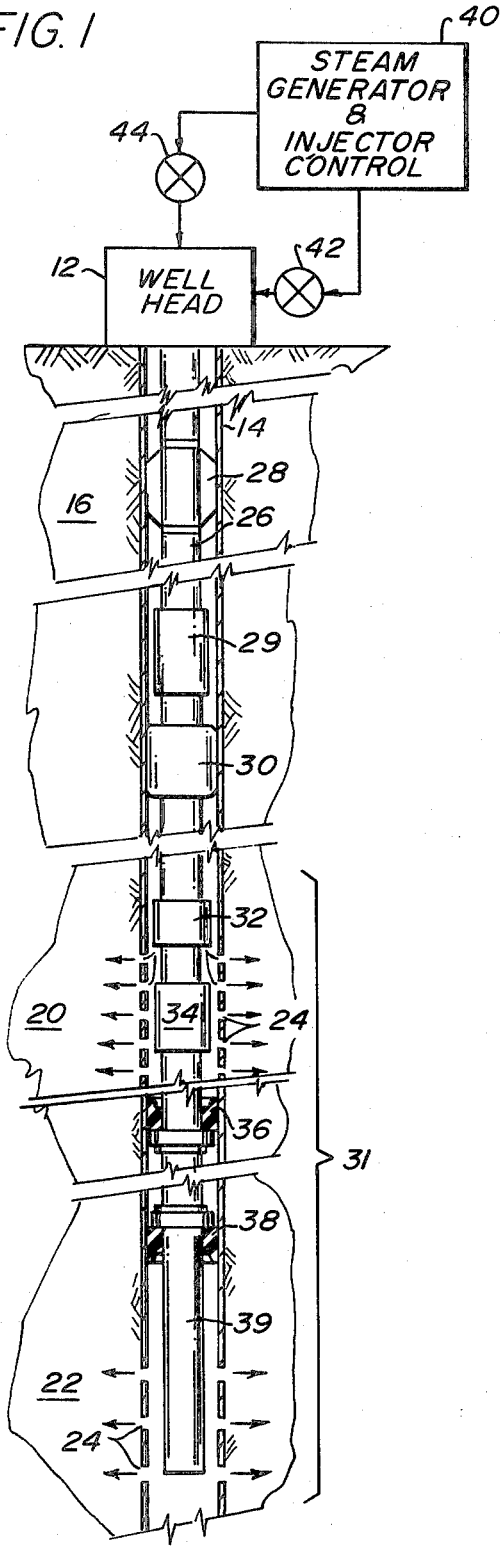
FIG. 1 is a cross-sectional view of a well bore penetrating a subsurface earth formation with downhole apparatus configuration in accordance with the present invention.

As shown in FIG. 1 a wellhead assembly 12 is the surface termination of casing 14 which has been placed into a well drilled into a subsurface earth formation 16. At the surface the casing is cemented to the earth formation; within the subsurface the casing 14 penetrates producing horizons 20 and 22 where the casing is provided with perforations 24 through which the desired hot fluids or steam are injected into the formation. Through the interior of the casing and laterally along the well a tubing string 26 is positioned so as to be centralized by centralizers 28 near the upper portions of the well bore and to be contained by a packer 30 some place above the producing horizons of interest. Suitable centralizers are shown in U.S. Pat. No. 4,099,564, issued to S. O. Hutchison on July 11, 1978 for Low Heat Conductivity Frangible Centralizers. Between the packer 30 and the wellhead 10 an expansion joint 29 is provided to allow for thermal expansion of the tubing string between the packer and the wellhead. Below the packer 30 the tubing string is provided with the downhole assembly 31 for distributing the injected materials into the horizons of interest. The equipment here shown includes a steam deflector 32 and a suitable crossover apparatus 34 to separate portions of the injected fluids for injection into the formation 20 from the remaining portion of the fluid to be injected into the formation 22. Between the two producing formations, the tubing string may also support opposed frangible cup packers 36 and 38 so as to isolate the injected fluids into the two separate producing formations. Suitable packers are shown in U.S. Pat. No. 4,129,308, issued Dec. 12, 1978 to S. O. Hutchison for Packer Cup Assembly. Below the lower packer 38 the inner tubing string terminates in an injection tubing 39 frequently referred to as a "stinger".

At the earth's surface a steam generator and injector control 40 is connected through a pair of valves 42 and 44 to the wellhead 10 for generating and controlling the injection of steam through the tubing string 26.

Figure 2:
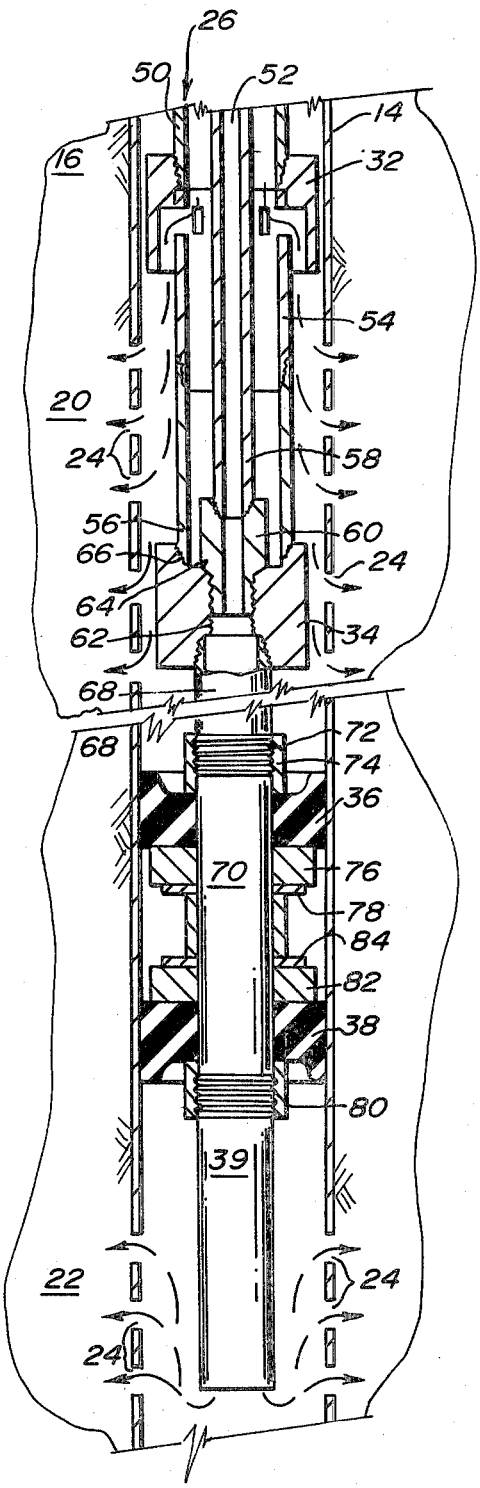
FIG. 2 is a sectional view of the downhole assembly illustrating the elements of the present invention.

FIG. 2 illustrates an enlarged sectional view of the downhole assembly of the present invention. As illustrated, the tubing string 26 includes an outer conductor or tubing 50 and an inner conductor or tubing 52. The lower end of the outer tubing 50 terminates in the steam deflector 32 with a male threaded portion of the outer conductor engaging an upper threaded portion of the steam deflector. A steam deflector is illustrated in U.S. Pat. No. 4,099,563, issued to Stanley O. Hutchison and Glenn W. Anderson, on July 11, 1978 for Steam Injection System For Use In A Well, and in U.S. Pat. No. 4,081,028, issued to Earl E. Rogers on Mar. 28, 1978 for Steam Distribution System For Use In A Well. The feature of the steam deflector is that it provides a passageway to the perforated casing for the steam carried in the annulus between the outside of the inner tubing and the inside of the outer tubing. The passageway is from that annulus outwardly into the annulus between the outside of the outer tubing and the inside of the casing 14. Such a steam deflector system is intended to provide a means for passing the steam outwardly into the outside annulus and for guiding it in the desired direction for injection into the formation. In the form illustrated in FIG. 2, the steam deflector passes the steam outwardly from the outer tubing 50 toward the perforations 24 adjacent to the producing horizon 20.

The steam deflector may include a lower extension 54 which may be coupled to additional sections of tubing string or may itself terminate in a threaded section at 56. The inner tubing 52 terminates in a tapered threaded portion 58 which is threaded into the internal threaded end of a seating sub 60 which has female threads at one end to accommodate the male threads of the inner tubing and the male extending threads 62 with a machined sealing surface at 64.

As illustrated in FIG. 2 the seating sub 60 of the inner tubing string 52 is threaded into an internal threaded portion of cross-over 34 and the machined sealing surface 64 is tightened into snug but releasable engagement with the inner metal surface of the cross-over to insure a complete seal of the inner tubing into the cross-over. The outer tubing 50 and the extension 56 below the steam deflector 32 threads into internal threads 66 of the cross-over to completely seal the annulus between the outside of the inner tubing and inside of the outer tubing.

A combination of the steam deflector and cross-over provide a means for causing the injected fluids from the annulus between the inner tubing and the outer tubing to flow outwardly through the deflector while the steam or hot fluids in the inner tubing pass through the cross-over into a lower extension thereof.

A connector tubing 68 threads into the lower end of the cross-over 34 and extends the inner tubing string downwardly into the subsurface to the next producing horizon 22. At the end of the connector tubing a packer mandrel 70 is provided which includes an external threaded portion 72 for cooperation with the make-up nut 74 for securing the upper packer 36 onto the packer mandrel. The opposite side of the packer is secured against a back-up ring 76 and held in place by a positioning ring 78. The upper packer 36 is an upward facing packer and is positioned below the cross-over 34 to prevent the injected fluids or steam deflected into the annulus between the outside of the outer tubing and the casing from passing downwardly beyond the packer 36. The combination of the deflector cross-over and upper packer 36 therefore, completely isolates the upper producing zone 20 from the lower producing zone 22.

The mandrel 70 of the upper packer extends downwardly into the area where a second, downwardly facing packer 38 is positioned. It should be understood that the mandrel may be of suitable length to accommodate any desired spacing between the upper and lower packers. The downward facing lower packer 38 is constructed similarly to the upper packer and includes a make-up nut 80 threaded onto the mandrel to hold the packer against back-up ring 82 and positioning ring 84. The formation and assembly of the packer cup in the form herein shown is shown in U.S. Pat. No. 4,129,308 issued to Stanley O. Hutchison on Dec. 12, 1978 for Packer Cup Assembly.

At the bottom end of the lower packer 38, the lower injection tubing or stinger 39 is positioned to provide for the injection of steam from the inner tubing string into the lower end of the casing in the vicinity of the perforations 24 adjacent to the producing formation 22. The lower packer 38 is a downwardly facing packer and functions to separate the lower producing horizon from the upper producing horizon and to prevent steam or hot fluids injected through the inner string from passing upwardly into the area of the other perforation.

The concentric steaming string from the present invention with its downhole apparatus provides for the injection of steam or other hot fluids into two producing horizons along the subsurface earth formation through a cased well. The advantage of the present system is that the entire assembly is positionable within the subsurface and, in the event that workover has to be performed on the well, the downhole portions of the apparatus may be washed over without loss of the complete downhole assembly. If such an action is to be needed, a hollow drilling tool may pass down over the entire tubing string and pass around the steam deflector and the cross-over and may there mill away at the downhole packers 36 and 38 to permit the annulus between the outside of the tubing string and the inside of the casing to be accessible to the earth's surface with conventional workover apparatus.

While a certain preferred embodiment of the invention has been specifically disclosed, it should be understood that the invention is not limited thereto as many variations will be readily apparent to those skilled in the art and the invention is to be given its broadest possible interpretation within the terms of the following claims.

What is claimed is:

1. A steam injection system for use with a concentric tubing string having an inner and an outer tubing for injecting steam into a well at a plurality of different vertical intervals comprising:

(a) a steam deflector fixed to the downhole end of the outer tubing string, said steam deflector providing exit ports for steam from within said outer tubing to the exterior of said outer tubing for injection at a first of said different vertical intervals;

(b) a cross-over means having (1) an input end including means connected to said inner tubing for partially supporting said cross-over from said inner tubing, and means connected to said steam deflector for partially supporting said cross-over from said outer tubing, said input end maintaining the separation between said inner and outer tubing;

(2) and an output end connected only to said inner tubing;

(c) connector tubing connected to said output end of said cross-over;

(d) an upward facing packer cup coupled to said connector tubing for sealing said well above said upward facing packer cup from said well below and providing an internal passage from said connector tubing to said well below;

(e) a downward facing packer cup coupled to said upward facing packer cup for sealing said well below said downward facing packer cup from said well above and providing an internal passage from said connector tubing for said well below;

(f) and means below said downward facing packer cup providing an exit port for steam from within said inner tubing for injection at a second of said different vertical intervals.

2. A steam injector assembly for use at a subsurface location along a perforated cased well with a steam injection, tubing string consisting of separate concentric inner and outer tubing elements comprising:

(a) deflecting means supported on said tubing string for deflecting steam from within said outer tubing element outward from said outer tubing;

(b) means supported on said tubing string for discharging steam from within said inner tubing element outward from said inner tubing;

(c) hollow packer means supported on said tubing string for separating said steam from said deflecting means from said discharged steam;

(d) and a cross-over means for terminating said outer tubing and for connecting said inner tubing to said packer means.

3. The steam injector assembly of claim 2 wherein said cross-over means includes a releasable threaded coupling between said inner tubing and said cross-over means.

4. The steam injector assembly of claim 3 wherein said releasable threaded coupling at said cross-over means includes a threaded element effecting a sealing contact between said inner tubing and said cross-over means.

5. The steam injector assembly of claim 2 wherein said packer means includes separate packer elements facing in opposite directions are cooperating with casing within said cased well, the upper packer element facing upward to seal steam deflected by said deflecting means from below said upper packer, and the lower packers element facing downward to seal steam from said inner tubing from above said lower packer.

6. The steam injector assembly of claim 2 wherein said inner tubing and said outer tubing of said concentric tubing are independent of each other above said cross-over means.

* * * * *